US008497633B2

(12) United States Patent
Aurongzeb et al.

(10) Patent No.: US 8,497,633 B2
(45) Date of Patent: Jul. 30, 2013

(54) CERAMIC METAL HALIDE DISCHARGE LAMP WITH OXYGEN CONTENT AND METALLIC COMPONENT

(75) Inventors: Deeder Aurongzeb, Mayfield Heights, OH (US); Emily Lauren Martis, Cleveland Heights, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/186,523

(22) Filed: Jul. 20, 2011

(65) Prior Publication Data

US 2013/0020936 A1 Jan. 24, 2013

(51) Int. Cl.

| | |
|---|---|
| ***H01J 61/20*** | (2006.01) |
| ***H01J 17/20*** | (2006.01) |
| ***H01J 9/26*** | (2006.01) |

(52) U.S. Cl.

USPC ..... 313/640; 313/637; 313/638; 313/639; 313/641; 445/46

(58) Field of Classification Search

USPC ..... 313/637–640

See application file for complete search history.

(56) References Cited

U.S. PATENT DOCUMENTS

| | | | | |
|---|---|---|---|---|
| 3,385,645 | A | 5/1968 | Smith | |
| 3,558,963 | A | 1/1971 | Hanneman et al. | |
| 5,022,882 | A * | 6/1991 | White et al. | 445/21 |
| 5,212,424 | A | 5/1993 | Russell et al. | |
| 5,461,281 | A | 10/1995 | Fromm et al. | |
| 5,866,982 | A | 2/1999 | Scott et al. | |
| 6,060,829 | A | 5/2000 | Kubon et al. | |
| 6,069,456 | A | 5/2000 | Fromm et al. | |
| 6,346,495 | B1 | 2/2002 | Dynys et al. | |
| 6,392,346 | B1 | 5/2002 | Newell et al. | |
| 6,833,676 | B2 * | 12/2004 | Brumleve | 313/638 |
| 7,057,350 | B2 * | 6/2006 | Lambrechts et al. | 313/640 |
| 7,868,553 | B2 | 1/2011 | Russell et al. | |
| 2005/0263568 | A1 * | 12/2005 | Stol | 228/107 |
| 2006/0164016 | A1 | 7/2006 | Rintamaki et al. | |
| 2006/0164017 | A1 | 7/2006 | Rintamaki et al. | |
| 2007/0120458 | A1 | 5/2007 | Rahmane et al. | |
| 2007/0120492 | A1 | 5/2007 | Selezneva et al. | |
| 2009/0058300 | A1 | 3/2009 | Lapatovich et al. | |

(Continued)

FOREIGN PATENT DOCUMENTS

| | | |
|---|---|---|
| EP | 784334 | 7/1997 |
| WO | 9953522 | 10/1999 |
| WO | 9953523 | 10/1999 |

OTHER PUBLICATIONS

PCT Search Report and Written Opinion dated Feb. 5, 2013 from corresponding Application No. PCT/US2012/046445.

*Primary Examiner* — Sikha Roy

(74) *Attorney, Agent, or Firm* — GE Global Patent Operation; Peter T. DiMauro

(57) ABSTRACT

Disclosed herein are lamps which comprises a discharge vessel comprised of a ceramic material; at least one electrode extending into the discharge vessel; an ionizable fill sealed within the discharge vessel, the fill comprising Hg, a buffer gas component, and a halide component comprising at least an alkali metal halide component and a rare earth halide component; a source of available oxygen; and a metallic component. The discharge vessel defines an interior space which comprises available oxygen during lamp operation conditions. Also disclosed herein are associated methods for making and using such lamps. Disclosed advantages may include mitigating some of the deleterious effects of highly electronegative species, enhanced lumens, and balancing the level of available oxygen for wall cleaning.

19 Claims, 2 Drawing Sheets

U.S. PATENT DOCUMENTS

| | | | | |
|---|---|---|---|---|
| 2009/0134759 | A1* | 5/2009 | Singh et al. | 313/25 |
| 2009/0146570 | A1 | 6/2009 | He et al. | |
| 2009/0146571 | A1 | 6/2009 | Russell et al. | |
| 2009/0251053 | A1 | 10/2009 | Ramaiah | |
| 2010/0013417 | A1 | 1/2010 | Ramaiah et al. | |
| 2010/0033114 | A1 | 2/2010 | Ramaiah | |
| 2011/0031879 | A1 | 2/2011 | Russell et al. | |
| 2011/0031880 | A1 | 2/2011 | Russell et al. | |

* cited by examiner

CERAMIC METAL HALIDE DISCHARGE LAMP WITH OXYGEN CONTENT AND METALLIC COMPONENT

FIELD OF THE INVENTION

The present invention relates generally to ceramic arc discharge lamps and more particularly to a discharge lamp in which a metallic component and an oxygen content of the lamp fill during lamp operation is selected to provide a high lumen maintenance.

BACKGROUND

Many known discharge lamps produce light by ionizing a vaporous fill material, such as a mixture of rare gases, metal halides and mercury with an electric arc passing between two electrodes. The electrodes and the fill material are sealed within a translucent or transparent discharge vessel that maintains the pressure of the energized fill material and allows the emitted light to pass through it. The ionizable fill material, also known as a "dose," emits a desired spectral energy distribution in response to being excited by the electric arc. For example, halides provide spectral energy distributions that offer a broad choice of light properties, e.g. color temperatures, color renderings, and luminous efficacies.

High Intensity Discharge (HID) lamps are high-efficiency lamps that can generate large amounts of light from a relatively small source. These lamps are widely used in many applications, including highway and road lighting, lighting of large venues such as sports stadiums, floodlighting of buildings, shops, industrial buildings, and projectors, to name but a few. The term "HID lamp" is used to denote different kinds of lamps. These include mercury vapor lamps, metal halide lamps, and sodium lamps. HID lamps differ from other lamps because their functioning environment requires operation at high temperature and high pressure over a prolonged period of time. Ceramic discharge chambers for HID lamps have been developed to operate at higher temperatures for improved color temperatures, color renderings, and luminous efficacies, while significantly reducing reactions with the fill material. Such lamps with ceramic discharge chambers have been termed "CMH HID" lamps. Metal halide (e.g., CMH) lamps are widely used because they may have a higher efficiency than incandescent lamps. This is economically and environmentally beneficial.

These lamps, however, may sometimes experience reduced light output with time due to darkening of the inside of the discharge chamber walls. This darkening is due to tungsten being transported from the tip of the electrode during operation to the inside wall, blocking light. It has been proposed to introduce a calcium oxide or tungsten oxide dispenser in the discharge vessel, as disclosed, for example in WO 99/53522 and WO99/53523. This has been also achieved in an exemplary embodiment with improved lumen maintenance in U.S. Pat. No. 7,868,553 and US Patent Publication 2010/0013417, each of which has a common assignee as the present disclosure.

Despite the superlative lumen maintenance shown by many of the lamps described in the above-noted commonly assigned patent and patent publication, there is generally a desire for even higher efficacy and longer life for CMH lamp, with reduced wall and seal corrosion.

BRIEF SUMMARY

One embodiment of the present invention is directed a lamp which comprises: a discharge vessel comprised of a ceramic material; at least one electrode extending into the discharge vessel; an ionizable fill sealed within the discharge vessel, the fill comprising Hg, a buffer gas component, and a halide component comprising at least an alkali metal halide component and a rare earth halide component; a source of available oxygen; and a metallic component. The discharge vessel defines an interior space which comprises available oxygen during lamp operation conditions.

A further embodiment of the present invention is directed to a method, comprising: sealing a source of available oxygen, a metallic component, and an ionizable fill within a discharge vessel comprised of a ceramic material, the fill comprising Hg, a buffer gas component, and a halide component comprising at least an alkali metal halide component and a rare earth halide component; and positioning electrodes within the discharge vessel configured to energize the fill in response to a voltage applied thereto. Such method is typically capable of manufacturing a lamp.

A further embodiment of the present invention is directed a method comprising: sealing a metallic component in a discharge vessel of a lamp, wherein the lamp comprises: a discharge vessel comprised of a ceramic material; at least one electrode extending into the discharge vessel; an ionizable fill sealed within the discharge vessel, the fill comprising Hg, a buffer gas component, and a halide component comprising at least an alkali metal halide component and a rare earth halide component; and a source of available oxygen. Such method typically is capable of balancing the level of available oxygen and/or avoiding corrosion of the ceramic material and seal material of the discharge vessel.

Other features and advantages of this invention will be better appreciated from the following detailed description.

BRIEF DESCRIPTION OF THE DRAWINGS

Embodiments of the invention will now be described in greater detail with reference to the accompanying Figures.

DETAILED DESCRIPTION

Figure 1:
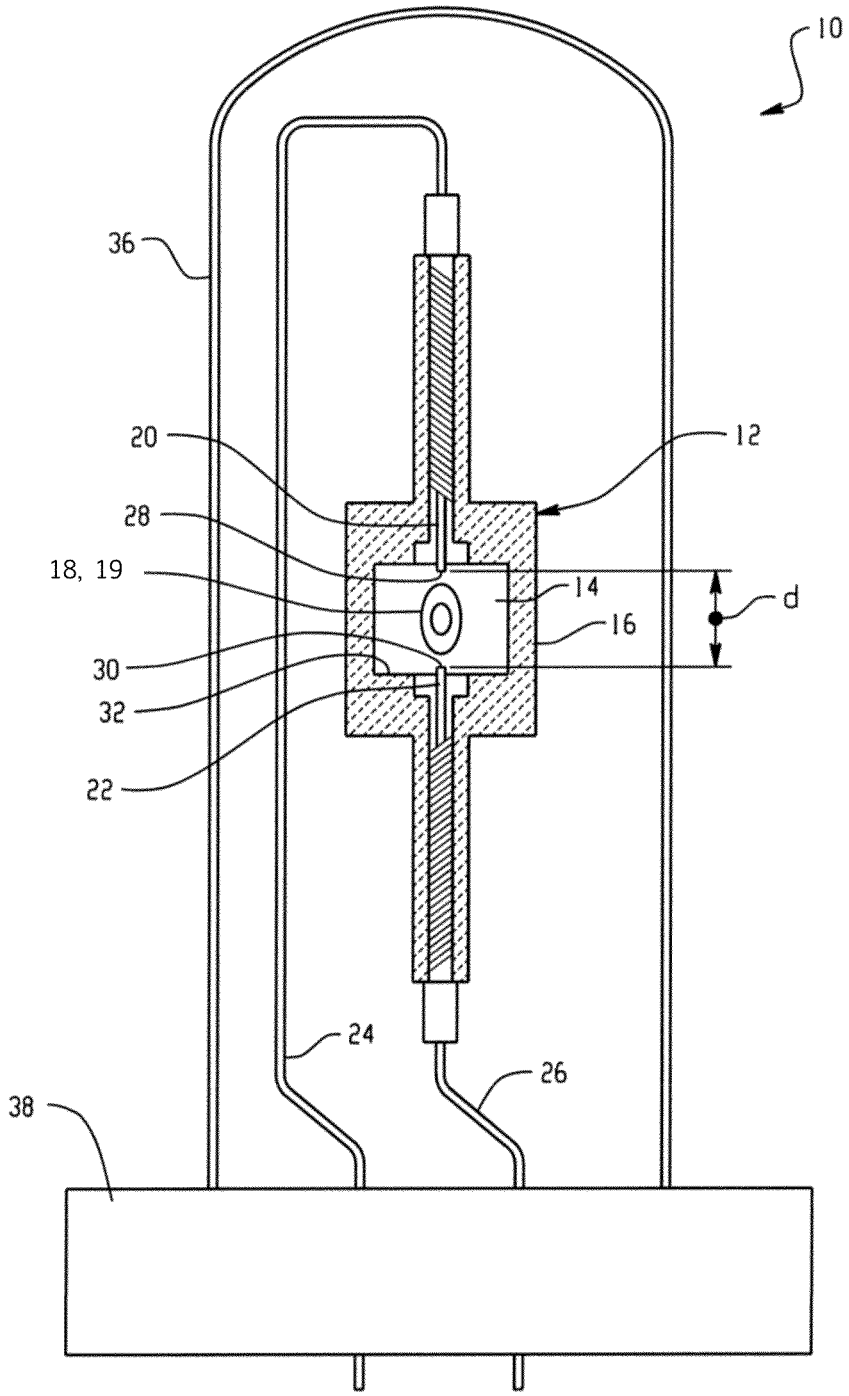
FIG. 1 is an exemplary embodiment of a schematic of a CMH HID lamp of the present disclosure.

As noted, an embodiment of the present invention is directed a lamp which comprises: a discharge vessel comprised of a ceramic material; at least one electrode extending into the discharge vessel; an ionizable fill sealed within the discharge vessel, the fill comprising Hg, a buffer gas component, and a halide component comprising at least an alkali metal halide component and a rare earth halide component; a source of available oxygen; and a metallic component. The discharge vessel defines an interior space which comprises available oxygen during lamp operation conditions. Typically, the lamp may be characterized as being a high intensity discharge lamp, e.g., a CMH HID lamp.

Typically, the metallic component is sealed within the discharge vessel, and it generally may comprise a metal present in zerovalent form and/or elemental form. In many embodiments, the metallic component may be comprised of a metal which capable of reacting with a portion of the available oxygen, often to form a metal oxide. Such capability may advantageously assist in mitigating some of the deleterious effects of available oxygen. The metallic component may form a metal oxide which can act as a protective layer for the arc tube or sealing materials, to further reduce corrosion due to excess liquid or gaseous halide present in typical discharge lamp. Although available oxygen (as would be understood by the person skilled in the art) offers numerous advantages, such as enhanced lumen maintenance in high intensity discharge lamps, the inventors of the present disclosure have ascertained that excessive available oxygen or other highly electronegative species (e.g., O, halogen) may sometimes promote arc instabilities (e.g., voltage rise or plasma fluctuations). Furthermore, oxygen may sometimes corrode the W shank or other electrode parts (e.g. Mo, Nb, Ir etc.). Yet furthermore, certain electronegative species in the fill of a high intensity discharge lamp may occasionally foster corrosion of alumina arc tubes or seal materials. Thus, a metallic component which has the capability of reacting with available oxygen may assist in balancing the level of available oxygen and/or avoiding corrosion of the ceramic material of the discharge vessel by forming a protective metal oxide layer.

In general, the metallic component may comprise a metal having an electronegativity less than about 2.0, such as an electronegativity of from about 0.8 to about 2.0, for example from about 1.0 to about 2.0. In certain embodiments, the metallic component may comprise a metal having a melting point of less than about 2500 K, preferably less than about 2000 K. Generally, a metallic component having such a low melting point would exclude refractory metal components of electrodes and wirings from the definition of "metallic component". In certain embodiments, the metallic component may comprise one or more of the following in zerovalent or elemental form: aluminum, gallium, indium, zirconium, titanium, manganese, calcium, silicon, hafnium, zinc, vanadium, lutetium, erbium, iridium, terbium, ytterbium, nickel, tin, and alloys of any one or more of the foregoing; or the like. That is, the metallic component may comprise an alloy of (for example) aluminum with any other metal or metalloid. In accordance with certain embodiments of the invention, the metallic component may comprise at least one: of a mixture of metals, an alloy, or an amalgam; or the like. In certain exemplary embodiments, the metallic component may comprise at least one of aluminum, calcium-silicon alloy, or zirconium.

The metallic component may be usually be free of typical refractory metals, e.g., free of any W, Nb, and Mo metal. In accordance with this description, "metallic component" is defined as not including the typical electrode materials and electrical wiring of discharge lamps, i.e., it is a separate component from the electrical wiring and electrodes, even if sometimes associated therewith.

Furthermore, in accordance with this description, the "metallic component" is further defined to comprise a metal other than Hg. Therefore, the metallic component generally comprises a metal not derived from any component of the ionizable fill. Thus, any unavoidable presence of atomic metal due to plasma decomposition of an ionizable fill would generally not constitute a metal of a "metallic component". The metallic component comprises a metal other than Hg, since Hg is considered to be derived from the ionizable fill.

The metallic component typically comprises the form of a pill, chip, flake, ball, speck, or particle of any shape; or the like. If the metallic component comprises a very low melting point (e.g., <400 K) material, it is possible to dose a metallic component as a liqueform alloy (e.g. InGaSn). These are the typical forms for a metallic component prior to initial lamp operation. After a lamp has sustained a discharge and a plasma forms inside the discharge envelope, the form of the metallic component may change to a molten and/or gaseous form, which may revert back to a particulate or film form upon re-cooling to an ambient temperature (e.g., after the lamp is turned off).

In certain embodiments, the metallic component may comprise a mixture of elemental metals or a metal alloy in which one of the metals in the mixture or alloy has a melting point of less than about 1000 K. The presence of a low melting portion of a metallic component may assist in forming the metallic component into an initial form of spheroidal pills.

In certain embodiments, the metallic component may be provided as a mixture with a non-metallic material (such as a metal oxide or an iodine or bromide salt). For example, one may provide the metallic component as a pill or particle comprising a metal in admixture with another solid, e.g., a solid form of a halide dose component (e.g., NaI). Similarly, for another example, one may provide the metallic component as a pill or particle of a metal in admixture with a solid form of a source of available oxygen (e.g., $MoO_3$, $WO_3$), or with a ceramic arc tube dopant (e.g., $Yb_2O_3$, $Lu_2O_3$, etc.). Mixing the metallic component with a non-metallic material may assist in accurately providing small quantities of metal. Examples of such combinations include Al—NaI mixture or Al—$WO_3$ mixture.

In accordance with some embodiments of the present disclosure, the metallic component may be associated with (e.g., doped into) an interior surface of the discharge vessel. In such embodiments, the metallic component preferably should be selected so as not to react adversely with ceramic walls and should not adversely affect optics. Associating the metallic component (especially if such component is selected to comprise, e.g., one or more of Hf, Zr, Yb, or Lu) with an interior surface of said discharge vessel may reduce the possibility of corrosion of the ceramic walls of a discharge vessel by electronegative materials in the fill.

In accordance with some embodiments of the present disclosure, the metallic component may be associated with a surface of an electrode. For example, to assist in vaporizing a metallic component, a metallic component may be provided as a particle or coating carried upon a pre-formed electrode. Alternatively, (for example) the metallic component may be provided as a pill form prior to discharge yet become at least partially redeposited upon an electrode (or other electrical wiring within the discharge vessel) after plasma vaporization and cool-down. The "metallic component" is nevertheless defined as not including the typical electrode materials and electrical wiring of discharge lamps, i.e., it is a separate component from the electrical wiring and electrodes, even if sometimes possibly associated therewith, as seen here.

In certain embodiments, the values for quantity of metallic component may be determined, at least in part, as a function of the amount of available oxygen and/or the amount of source of available oxygen, without any undue experimentation. As will be discussed in further detail below, the materials and quantities of the source of available oxygen and of the metallic component may generally be selected to provide available oxygen in the lamp during lamp operation.

As concrete examples, the metallic component may be sealed within the vessel in an amount greater than about 0.2 μmol (micromol)/mL, e.g., greater than about 0.3 μmol/mL. In some embodiments, the metallic component may be sealed within the vessel in an amount less than 10.0 μmol/mL, e.g., less than 8.0 μmol/mL. Other ranges may be possible, such as from about 0.2 μmol/mL to about 10.0 μmol/mL. Higher quantities of metallic component may sometimes be employed. As used in this description, the term "mL" refers to of volume of the interior space; also, the term "volume" or "lamp volume" is synonymous to "volume of the interior space defined by the discharge vessel". In one specific embodiment, the metallic component may be provided as a mixture (e.g., in pill form) of aluminum metal (at 0.2 mg/lamp) and $WO_3$ (at 0.1 mg/lamp).

As noted, the discharge vessel defines an interior space which comprises available oxygen during lamp operation conditions. As used herein, "available oxygen" generally may refer to oxygen in any form, combined or elemental, which is capable of participating in a wall cleaning cycle at the operating temperature of the lamp. "Wall cleaning cycle", as would be generally understood by persons skilled in the art, is explained in terms of the following. One possible problem with CMH HID lamps (in general) is that the light output over time (typically expressed as lumen maintenance) may tend to diminish due to darkening of the walls of the discharge vessel. The blackening may be due to electrode material (e.g, tungsten) being transported from the electrode to the wall. Available oxygen may aid in the cleaning the wall and thus can improve lumen maintenance over the lifetime of the lamp. Therefore, "available oxygen" typically may refer to any active form of oxygen as it exists during lamp operation which is effective to participating in a wall cleaning cycle at the operating temperature of the lamp.

In some embodiments, for example, a gaseous compound (such as an oxide or oxyhalide of tungsten; or an oxyhalide of certain rare earth elements; whether in neutral or ionic form or whether in stoichometrically balanced or nonstoichiometric form) can comprise "available oxygen". In other embodiments, available oxygen can take the form of neutral or ionic forms of elemental oxygen. Furthermore, other forms of available oxygen are possible. These foregoing embodiments are not necessarily mutually exclusive. Available oxygen can exist in several forms in a lamp at substantially the same time. A functional definition of "available oxygen" is necessary in this case since (as would be well understood), during the electrical discharge process, a variety of different species can exist depending on dose chemistry, temperature, electrical input, etc.

In the particular case where wall darkening/wall blackening is caused by deposition of tungsten transported from an electrode to a ceramic vessel wall, available oxygen is a form of oxygen which is capable of reacting or removing this tungsten from the wall to form, e.g., $WO_aX_b$ where X is a halogen and a is from about 2 to about 3 (usually from 2 to 3) and b is from about 0 to about 2 (usually from 0 to 2).

Available oxygen is reported as moles of O (i.e., atomic O), even though, as explained above, available oxygen can exist in many forms. For instance, if 1 mol of $WO_3$ is present in a lamp, and all of its oxygen content functions as available oxygen, this is reported as 3 mol of O. The quantity of available oxygen in a lamp may be typically described by ratios such as micromoles [μmol] O per mL of lamp volume.

Generally, the available oxygen in a lamp may comprise a concentration of at least about 0.05 (e.g., at least about 0.1) μmol O/mL. For example, the interior space may comprise available oxygen in a concentration of from about 0.1 to about 3.0 μmol O/ml, more narrowly, from about 0.2 to about 2.5 μmol/mL. Typically, the quantity of available oxygen may be a function of the nominal power at which the lamp is designed to function. For example, a lamp configured to operate at about 39 W nominal power may comprise available oxygen in a concentration of from about 0.25 to about 1.83 μmol O/mL. A lamp configured to operate at about 70 W nominal power may comprise available oxygen at a concentration of from about 0.25 to about 2.4 μmol O/mL of lamp volume. Some appropriate values for concentration of available oxygen may be found in commonly-assigned U.S. Pat. No. 7,868,553 and US Patent Publication 2010/0013417, each of which is hereby incorporated by reference in pertinent part. Generally, too much available oxygen in the interior space of a discharge vessel of a lamp would lower initial lumens, but too little available oxygen would lower lumen maintenance.

Various methods exist for determining the available oxygen, including inert gas fusion, energy dispersive X-ray analysis (EDAX), and Electron Spectroscopy for Chemical Analysis (ESCA, also known as XPS). For example, oxygen can be measured at concentrations as low as 1 ppm by an inert gas fusion technique, such as with a LECO oxygen analyzer, available from LECO Corp. In one embodiment, the oxygen content is determined by analysis of the mixture of ionizable fill and source of available oxygen prior to introduction to the lamp, e.g., with LECO. This method assumes that the dose mixture is the only source of oxygen. This assumption is accurate provided that oxygen is not added to the discharge vessel in significant amounts from other sources, e.g., through intentional oxidation of the tungsten electrodes or inadvertent introduction of oxygen gas. The assumption can be validated by measuring the oxygen content of the dose pool (equilibrated mixture of ionizable fill and source of available oxygen) after several hours of lamp operation. If oxidized electrodes are used, the contribution of the oxygen in the electrodes should be taken into account in determining the available oxygen. Another way to determine the oxygen content is to prepare a lamp then analyze the dose pool, e.g., by breaking open a lamp and analyzing the lamp contents. This should be done before extended lamp operation takes place, since during lamp operation, oxygen may tend to be consumed. Additionally, the lamp should be opened in an oxygen free atmosphere so that atmospheric oxygen does not influence the results. In this method, EDAX or ESCA may be used to determine the oxygen content. In tests on lamps, the LECO method and EDAX method give reasonable agreement, provided that care is taken in the EDAX method to exclude external sources of oxygen.

Generally, in accordance with this disclosure, the interior space may comprise a volume of from about 0.12 ml to about 2.0 mL. Higher or lower values may be possible. Typically, the volume of the interior space depends on nominal operating wattage of a lamp. For example, it may comprise from about 0.12 mL to about 0.3 mL for a 39 W ceramic metal halide lamp; from about 0.15 mL to about 0.4 mL for a 70 W ceramic metal halide lamp; and from about 0.5 mL to about 2.0 mL for a 250 W ceramic metal halide lamp. Other volumes are possible.

The available oxygen in a lamp is provided by a source of available oxygen. Typically, but not always, a source of available oxygen is selected to be capable of providing available oxygen by decomposition under lamp operating conditions. It may often comprise an unstable metal oxide or an unstable metal oxyhalide. In accordance with certain embodiments, the source of available oxygen is capable of providing a first molar quantity of available oxygen under lamp operating conditions, and wherein the metallic component is capable of reacting with a second molar quantity of oxygen, and wherein the first molar quantity is greater than the second molar quantity (each of said molar quantity of oxygen expressed as O). That is, the present disclosure embraces embodiments wherein the metallic component may be present in a molar quantity insufficient to react with all the available oxygen releasable by the source of available oxygen. Stated another way, the lamp may comprise available oxygen under lamp operating conditions in amounts beyond that which is needed to consume all of the metallic component. If too much metallic component is present, it might consume all the available oxygen. In general, it may be stated that the source of available oxygen and the metallic component may comprise respective molar quantities selected to provide available oxygen at an optimum concentration for lumen maintenance.

However, it is sometimes possible for the metallic component to be present within the interior space of the discharge vessel in an amount in excess of the available oxygen, if some of the metallic component is in a form inaccessible to oxygen in the fill, and/or at a temperature which is too low to react with oxygen in the fill. For example, if a pill of a metallic component (e.g., Al, In, Sn, etc.) is introduced to a lamp at the time of manufacture (along with a source of available oxygen), it is possible for some of that aluminum to be trapped at a cold spot after vaporization and cool-down, so that it is inaccessible and/or unreactive to the oxygen in the fill. Regardless, in accordance with the present invention, the interior space of the lamp always comprises at least some available oxygen during at least some of the time that the lamp is under lamp operation conditions. One of the advantages for a lamp which comprises both a source of available oxygen and a metallic component which is capable of reacting with oxygen, is in ease of manufacturing. To achieve the desired level of available oxygen needed for prolonged lumen maintenance, one may "overdose" the lamp with an accurately measured quantity of a source of available oxygen, and then bind some of that oxygen with a metallic component, so as to arrive at the desired level.

The source of available oxygen typically may be sealed within the discharge vessel at the time of manufacture, and then may become capable of providing available oxygen to the fill during lamp operation, e.g., by decomposition. As used herein, the term "source of available oxygen" is intended to refer to any material which comprises available oxygen per se, or (more typically) which comprises a substance which can be converted into available oxygen though, e.g., decomposition, or through reaction with a fill component. A source of available oxygen may be a single compound (e.g., tungsten trioxide) or a mixture of compounds, or a mixture of one or more compound and one or more element. For example, it may be convenient to employ a mixture of substances as a "source of available oxygen". For example, a mixture of sodium halide and tungsten trioxide may be such a source: in this example, the source of available oxygen comprises a substance which is not able to be converted to available oxygen (sodium halide), and also comprises another substance which can be converted to available oxygen (tungsten trioxide).

As will be appreciated, certain oxides do not decompose readily to form available oxygen under lamp operating conditions, such as cerium (III) oxide ($Ce_2O_3$) and calcium oxide, and thus do not tend to act effectively as sources of available oxygen. In general, many oxides of rare earth elements (RE) in their trivalent form ($RE_2O_3$) are not suitable sources of available oxygen if they are stable at lamp operating temperatures. However, other rare earth oxides, especially in tetravalent form (e.g., $CeO_2$) may be suitable as sources of available oxygen, since $CeO_2$ partially (although not wholly) decomposes under lamp operating conditions to provide available oxygen.

In certain embodiments, the source of available oxygen may comprise one or more of $O_2$, $H_2O$, (optionally solid) metal oxide, or (optionally solid metal oxyhalide; or the like. When a metal oxide or metal oxyhalide is employed as a source of available oxygen, it generally chosen to be unstable under lamp operating temperatures so as to release available oxygen; i.e., it is an unstable metal oxide or metal oxyhalide. In accordance with certain embodiment of the disclosure, the source of available oxygen comprises an oxide or oxyhalide of at least one of Hg, Ba, Zr, Hf, W, Mo, Eu, Yb, or Lu, or the like; or other metal oxide such as cerium dioxide or lanthanum dioxide. In many embodiments, the source of available oxygen may comprise an oxide or oxyhalide of tungsten, e.g., a pill comprising $WO_3$. In some embodiments, $WO_3$ may be provided as a source of available oxygen by intentionally oxidizing a small portion of a tungsten electrode prior to sealing the lamp.

The source of available oxygen may be selected in accordance with its ability to clean any electrode material deposited on the interior wall of the discharge vessel. Thus, in general, the at least one electrode comprises an "electrode material", and therefore the source of available oxygen and ionizable fill may be selected to cause reaction of any electrode material deposited on an interior wall of the discharge vessel. At least one of available oxygen or reaction products of available oxygen with ionizable fill, is capable of reacting with at least some of any electrode material deposited on the interior wall. For lamps wherein the electrode material comprises tungsten, at least one of available oxygen or reaction products of available oxygen with ionizable fill, may be capable of reacting with any tungsten deposited on an interior wall of the discharge vessel to form a tungsten oxide or $WO_2X_2$ where X is a halide.

As noted, lamps in accordance with this disclosure comprise an ionizable fill sealed within the discharge vessel, the fill comprising Hg. The mercury may be present at any effective level, e.g., any level effective to support the discharge, including certain levels which are heretofore known for CMH HID lamps. In certain embodiment, the lamp may comprise Hg in an amount of from about 2 to 15 mg/mL of the arc tube volume. However, lower values may be possible, as well as desirable, for environmental considerations. In general, the mercury weight may be adjusted to provide the desired arc tube operating voltage ($V_{op}$) for drawing power from a ballast. The fill also comprises a buffer gas. Such buffer gas, may be, for example argon, xenon, krypton, or a combination thereof, and may be present in the fill at from about 2-20 μmol/mL. The buffer gas may be sealed within the vessel at a cold fill pressure of from about 60 to about 300 torr. Higher and lower pressures may be possible. Too high a pressure, may compromise starting. Too low a pressure can lead to increased lumen depreciation over the life of the lamp.

In accordance with this invention, the ionizable fill comprises a halide component comprising at least an alkali metal halide component and a rare earth halide component. Optionally the halide component may also further comprise an alkaline earth metal halide component and/or a Group 13 metal halide component. The term "halide component" is a collective term referring to all metal halide compounds in the fill. The term "rare earth halide component" is a collective term referring to all rare earth metal halide compounds in the fill. Similarly, the term "alkali metal halide component" is a collective term referring to all alkali metal halide compounds in the fill. In general, the halide component may be present in the fill in any effective quantity; some suitable ranges may include a concentration by weight of from about 5 to about 280 mg/mL (e.g., from about 5 or about 8 to about 80 mg/mL of the arc tube volume), or more narrowly, from about 10 to about 60 mg/mL.

The halide(s) in the halide component can each be selected from chlorides, bromides, iodides and combinations thereof. In one embodiment, the halides are all iodides. Iodides tend to provide longer lamp life, as corrosion of the arc tube and/or electrodes is lower with iodide components in the fill than with otherwise similar chloride or bromide components.

Generally, any rare earth halide in the fill should be selected such that it substantially does not form a stable oxide. That is because, if a rare earth halide were to form a stable oxide, it would consume available oxygen in the lamp. In many embodiments, the rare earth halide component may comprise a halide of one or more selected from lanthanum, cerium, praseodymium, neodymium, or samarium; or the like. In some embodiments, the rare earth halide component may comprise a lanthanum halide.

In certain embodiments, the rare earth halide component may be free of all rare earth halides other than halide of one or more selected from lanthanum, cerium, praseodymium, or samarium. In certain embodiments, the rare earth halide component is free of halides of Tb, Dy, Ho, Tm, and Lu. This lattermost embodiment may be advantageous so as to avoid the presence of rare earth halides that form stable metal oxides, halides which could bind available oxygen. In accordance with embodiments of the invention, the ionizable fill may be free of Sc and Pr in elemental or compound form. Scandium and praseodymium may often be absent from the fill since they are considered as being chemically aggressive; they can contribute to leaks in the vessel envelope.

As used herein, "free", when used in the context of "being free of" a particular substance, generally means that an element is present (in either elemental or compound form) in no greater than normal impurity amounts as part of the discharge vessel, electrodes, and/or other components of the fill. Of course, the term "free" may also be used in the context of a substance, such as an element, which is in uncombined (i.e., non-compound) form and is thus "free". (For example, free aluminum typically may refer to aluminum in solid, liquid or gas form (neutral or ionic) but not combined with other elements). The person of ordinary skill in the art would understand the meaning of the term "free" from the context in which the term is used.

In accordance with embodiments of the disclosure, the halide component in the ionizable fill may comprise a rare earth halide component in a mole fraction of from about 0.10 to about 0.20. Other ranges may be possible, for example, from about 0.05 to about 0.15, or from about 0.2 to about 0.4. In accordance with embodiments of the disclosure, the rare earth halide component may be present in the fill at a total concentration of, for example, from about 0.3 to about 13 μmol/mL. These ranges are independently selectable.

As noted, the ionizable fill comprises an alkali metal halide component. In some embodiment, the alkali metal halide component may comprise a sodium halide, e.g., NaI. The total halide component in the ionizable fill may comprise an alkali metal halide component in a mole fraction of from about 0.2 to about 0.9 (possibly from about 0.2 to about 0.6). The alkali metal halide may be present in the fill at a total concentration of, for example, from about 10 to about 300 μmol/mL. These ranges may be independently selectable.

In many embodiments, the halide component may further comprise an alkaline earth metal halide component, which usually comprises at least one of calcium halide or strontium halide. The total halide component in the ionizable fill may comprise an alkaline earth metal halide component in a mole fraction of from about 0.1 to about 0.55 (possibly from about 0.25 to about 0.55).

In many embodiments, the halide component may further comprise an Group 13 metal halide component, which usually comprises at least one of indium halide, gallium halide, or thallium halide. Generally, thallium halide (e.g., TlI) is preferred. The total halide component in the ionizable fill may comprise an alkaline earth metal halide component in a mole fraction of from about 0.03 to about 0.09. It is also possible, in some embodiments, for the halide component to further comprise at least one halide of a transition metal element.

In one specific embodiment, the ionizable fill may comprise (or consist of) halides (e.g., iodides) of Na, Ca, Tl, and La.

Typically, the discharge vessel may comprise a wall comprised of a substantially translucent or transparent ceramic material. Exemplary ceramic materials may include one or more of alumina (e.g., polycrystalline alumina, PCA) or zirconia; or the like. The use of PCA allows the lamp to run at higher temperatures than a quartz lamp without suffering devitrification. Other ceramic materials which may be used include non-reactive refractory ceramics such as sapphire, yttrium oxide, lutetium oxide, aluminum nitride, spinel, and hafnium oxide and their solid solutions and compounds with alumina such as yttrium-aluminum-garnet (YAG) and aluminum oxynitride. Other ceramic materials are contemplated to be within the scope of the disclosure and it should not be construed as limited only to those named. The ceramic material may be doped with one or more of creep inhibitor or grain-growth inhibitor or grain-boundary stabilizer (e.g., MgO, $Yb_2O_3$, $Ta_2O_5$, $Lu_2O_3$, etc). Usually, however, the discharge vessel will not be substantially comprised of quartz or any material which unavoidably may decompose to release trace oxygen.

A typical ceramic discharge lamp according to this disclosure includes an elongated ceramic discharge vessel containing the ionizable fill. This discharge vessel may have a central portion which defines an interior space, the central portion having a longer axis and a shorter axis. Within the discharge vessel can generally be positioned at least one (usually at least two) electrodes so as to energize the dose when an electric current is applied thereto. Generally, the discharge vessel may be a ceramic arc tube having an specified aspect ratio, usually selected as function of the wattage at which the lamp is operated.

For vessels with a generally cylindrically shaped central portion, the central portion includes a substantially cylindrical wall and two spaced end walls connected at both ends of the cylindrical wall, the end walls lying generally perpendicular to the longer axis. (The central part of the arc tube is preferentially cylindrical geometry but may also be elliptical, spherical, or intermediate shapes). Vessels according to this disclosure may also include at least two end portions or "legs", extending from the two spaced end walls, and these leg portions each support at least one electrode at least partially therein. A ceramic metal halide arc tube can be of a three part construction, and may be formed, for example, as described, for example, in any one of U.S. Pat. Nos. 5,866,982; 6,346,495; 7,215,081; and U.S. Pub. Nos. 2006/0164017; 2007/0120458, 2006/0164016, and 2007/0120492, all of which are hereby incorporated by reference. It will be appreciated that the arc tube can be constructed from fewer or greater number of components, such as one or five components.

In accordance with embodiments of the invention, the lamp comprises at least one (usually two but possible more) electrodes which can be powered for sustaining an arc discharge. The at least one electrode may comprise a refractory metal (e.g., at least one of W, Mo, or Nb) or a cermet. The refractory metals are often doped (>1%) with Re for better stability. In one embodiment, the at least one electrode may comprise a tungsten tip or tube (e.g. hollow cathode), a niobium portion which feeds through the discharge vessel, and a molybdenum overwind portion. In another embodiment, the at least one electrode may comprise a cermet portion comprised of a ceramic (e.g. alumina, YAG etc.) and Mo, Ir, and/or Ru metal, e.g., a dispersion of >50% Mo in alumina with an electrode portion comprised of W. The at least one electrode is configured within the discharge vessel to energize the ionizable fill when an electric current is applied thereto.

Typically, lamps according to embodiments of the invention have a nominal power (or power rating) in the range of from about 20 to about 400 W. As used herein, the term "rated power", "nominal lamp power" and "lamp power rating", or any version thereof, which may be used interchangeably herein, refers to the optimum wattage at which the lamp is intended to be operated, in accord with industry standards. Generally, a lamp according to embodiments of the invention is part of a lighting assembly which also comprises a ballast, e.g., electronic ballast. In some embodiments, lamps according to the invention operate at an arc tube wall loading of from about 20 to about 40 W/cm$^2$, for example, about 35 W/cm$^2$. Higher values are also possible. In accordance with some embodiments, the lamp may be configured to operate with a ballast, e.g., a magnetic ballast (capable of operating at about 50-60 Hz) or an electronic ballast (capable of operating at >60 Hz).

Lamps in accordance with embodiments of the present disclosure have numerous advantages. For example, such lamps may exhibit greater lumen maintenance at 1000, 2000, and 3000 h versus an identical lamp without the metallic component. Adequate lumen maintenance may be exemplified by lamps which are capable of greater than about 90% (e.g., 90-95%) lumen maintenance after operation at about 4800 h relative to the lumens for the same lamp at 100 h.

As noted, the present invention is also directed to a method, comprising: sealing a source of available oxygen, a metallic component, and an ionizable fill within a discharge vessel comprised of a ceramic material, the fill comprising Hg, a buffer gas component, and a halide component comprising at least an alkali metal halide component and a rare earth halide component; and positioning electrodes within the discharge vessel configured to energize the fill in response to a voltage applied thereto. Such method may be characterized as being capable of forming a lamp, e.g., a CMH HID lamp.

Furthermore, the present invention is also directed to a method comprising: sealing a metallic component in a discharge vessel of a lamp; wherein said lamp comprises: a discharge vessel comprised of a ceramic material, at least one electrode extending into the discharge vessel, an ionizable fill sealed within the discharge vessel, the fill comprising Hg, a buffer gas component, and a halide component comprising at least an alkali metal halide component and a rare earth halide component, and a source of available oxygen. Such method may be capable of balancing the level of available oxygen in a high intensity discharge lamp employing available oxygen for wall cleaning. Such method may also avoid oxygen corrosion in an CMH lamp, since the relatively low electronegativity of the metallic component may protect the ceramic arc tube material from damage by relatively high electronegative species. Such method may also exhibit a higher lumen output at short life times (e.g., at 100 h), versus the identical lamp not comprising the metallic component. Without being limited by theory, this may be due to the lumen contribution from the metallic component itself under lamp operating conditions, and reduction of the problem of free halide or halogen.

With reference to FIG. 1, a cross-sectional view of an exemplary CMH HID lamp 10 is shown. Such lamp embodies a common, but nonlimiting, configuration for lamps in accordance with this disclosure. The exemplary lamp includes a discharge vessel (or arc tube) 12, which defines an interior space 14. The discharge vessel 12 has a wall 16 formed of a ceramic material, such as alumina. An ionizable fill 18 is sealed in the interior space 14. The metallic component 19 is also sealed within the interior space 14. Electrodes (typically comprising tungsten) denoted 20, 22 are positioned at opposite ends of the discharge vessel so as to energize the fill when an electric current is applied thereto. The two electrodes 20 and 22 are typically fed with an alternating electric current via conductors 24, 26 (e.g., from a ballast, not shown). Tips 28, 30 of the electrodes 20, 22 are spaced by a distance d, which defines the arc gap. When the HID lamp 10 is powered, indicating a flow of current to the lamp, a voltage difference is created across the two electrodes. This voltage difference causes an arc across the gap between the tips 28, 30 of the electrodes. The arc results in a plasma discharge in the region between the electrode tips 28, 30. Visible light is generated and passes out of the interior space 14, through the wall 16.

The electrodes become heated during lamp operation and tungsten tends to vaporize from the tips 28, 30. Some of the vaporized tungsten may deposit on an interior surface 32 of wall 16. Absent a regeneration cycle, the deposited tungsten may lead to wall blackening and a reduction in the transmission of the visible light. The exemplary arc tube 12 is surrounded by an outer bulb 36 that is provided with a lamp cap 38 at one end, through which the lamp is connected with a source of power (not specifically shown). The bulb 36 may be formed of glass or other suitable material. The lighting assembly 10 also generally includes a ballast (not specifically shown), which acts as a starter when the lamp is switched on. The ballast is located in a circuit that includes the lamp and the power source. The space between the arc tube and outer bulb may be evacuated.

In order to promote a further understanding of the invention, the following examples are provided. These examples are illustrative, and should not be construed to be any sort of limitation on the scope of the claimed invention.

EXAMPLES

Comparative Example, Example 1, Example 2

A series of 70 W ceramic metal halide single-ended lamps were formed in identical fashion, with a substantially cylindrical arc tube. Each lamp was provided with a specified ionizable fill, according to the parameters shown in Table 1. The lamps had a barrel length (IBL) of 8.6 mm. The Hg content, Ar buffer gas, and dose weight for the ionizable fill was the same in each case, denoted the "standard Ultra dose". The volume of the interior space was 0.24 mL.

Lamps of the Comparative Example did not contain any of the inventive metallic component, whereas the lamp of Example 1 employed aluminum metal and the lamp of Example 2 employed a mixture of zirconium metal and calcium-silicon alloy.

All of the lamps were constructed and formulated so as to achieve a target quantity of available oxygen of approximately 0.4 μmol O/mL. In the case of Comparative Example, the quantity of $WO_3$ was expected to completely contribute to available oxygen during lamp operation, and thus the quantity of $WO_3$ appeared to be much lower than in Example 1 and Example 2. This does not mean that the amount of available oxygen was different for any of the lamps under lamp operation. This is because, for Example 1 and Example 2, a greater quantity of $WO_3$ could be initially provided to the interior space of the discharge vessel, and the metallic component would back-react with any excess available oxygen so as to result in the same target quantity of available oxygen of approximately 0.4 μmol O/mL.

TABLE 1

| | Watts (W) | Halide Component (mole fraction) | Source of available oxygen (mg/lamp) | metallic component (mg/lamp) | Target quantity available oxygen (μmol/mL) | Volume of interior space (mL) |
|---|---|---|---|---|---|---|
| Comparative Example | 70 | $LaI_3$:NaI:TlI:$CaI_2$: :0.11:0.53:0.07: 0.29 | $WO_3$ (0.007) | none | 0.4 | 0.24 |
| Example 1 | 70 | $LaI_3$:NaI:TlI:$CaI_2$: :0.11:0.53:0.07: 0.29 | $WO_3$ (0.1) | aluminum (0.2) | 0.4 | 0.24 |
| Example 2 | 70 | $LaI_3$:NaI:TlI:$CaI_2$: :0.11:0.53:0.07: 0.29 | $WO_3$ (0.1) | CaSi/Zr mixture (0.2) | 0.4 | 0.24 |

Figure 2:
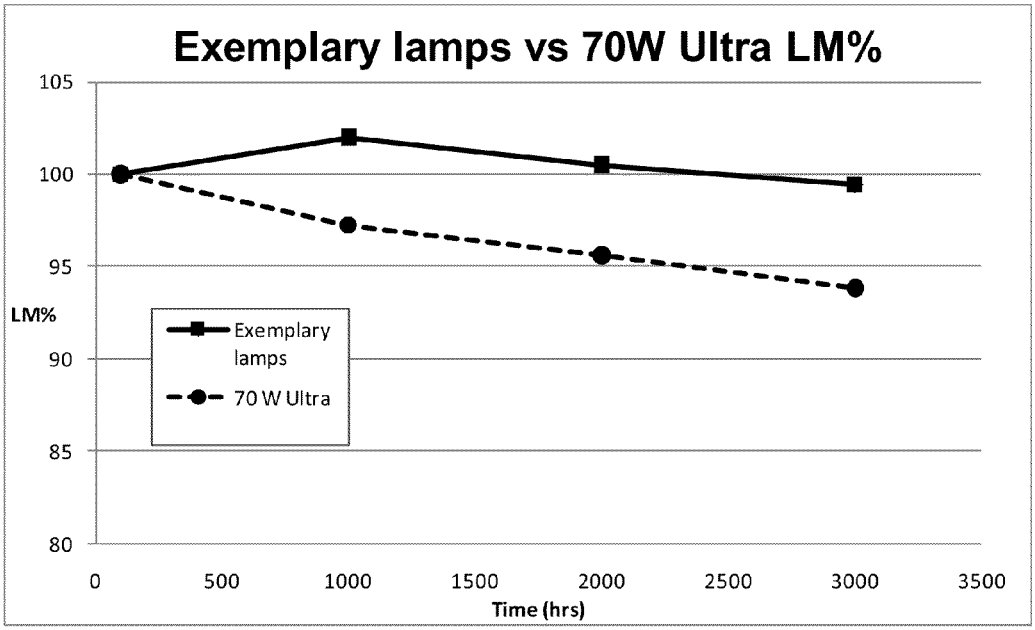
FIG. 2 is a plot of relative lumens vs. time for comparative lamps and lamps according to embodiments of the disclosure.

FIG. 2 demonstrates the enhancement in lumen maintenance for the lamps of Example 1 and Example 2 (denoted "Exemplary Lamps" in the Figure) in contrast to the lamp of the Comparative Example (denoted "70 W Ultra"). Notable is that fact that substantially 100% of initial lumens had been maintained even at 1000, 2000 and 3000 h for the Exemplary Lamps. Surprisingly, the efficiency of the lamps of Example 1 and Example 2 had a higher efficiency (94 LPW, lumens/W) at 100 h burn time, as compared to Comparative Example (89 LPW). Without being limited by theory, this is taken to be indicative of a contribution to lumens made by the metallic component.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" used in connection with a quantity is inclusive of the stated value and has the meaning dictated by the context (for example, includes the degree of error associated with the measurement of the particular quantity). "Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present. The singular forms "a", "an" and "the" include plural referents unless the context clearly dictates otherwise. All ranges disclosed herein are inclusive of the recited endpoint and independently combinable.

As used herein, the phrases "adapted to," "configured to," and the like refer to elements that are sized, arranged or manufactured to form a specified structure or to achieve a specified result. While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims. It is also anticipated that advances in science and technology will make equivalents and substitutions possible that are not now contemplated by reason of the imprecision of language and these variations should also be construed where possible to be covered by the appended claims.

What is claimed as new and desired to be protected by Letters Patent of the United States is:

1. A lamp comprising:

a discharge vessel comprised of a ceramic material;

at least one electrode extending into the discharge vessel;

an ionizable fill sealed within the discharge vessel, the fill comprising Hg, a buffer gas component, and a halide component comprising at least an alkali metal halide component and a rare earth halide component;

a source of available oxygen; and a metallic component;

wherein the discharge vessel defines an interior space which comprises available oxygen during lamp operation conditions; and wherein materials and quantities of the source of available oxygen and of the metallic component are selected to provide available oxygen in the lamp during lamp operation and wherein the available oxygen comprises a concentration of at least about 0.05 μmol O/mL.

2. The lamp in accordance with claim 1, wherein the metallic component comprises a metal having an electronegativity less than about 2.0.

3. The lamp in accordance with claim 1, wherein the metallic component comprises a metal having a melting point of less than about 2500 K.

4. The lamp in accordance with claim 1, wherein the metallic component comprises a metal not derived from any component of the ionizable fill.

5. The lamp in accordance with claim 1, wherein the metallic component comprises one or more of the following in zerovalent or elemental form: Al, Ga, In, Zr, Ti, Mn, Ca, Si, Zn, V. Lu, Er, Ir, Tb, Yb, Ni, or Sn, or alloys thereof.

6. The lamp in accordance with claim 5, wherein the metallic component comprises at least one of aluminum, calcium-silicon alloy, or zirconium.

7. The lamp in accordance with claim 1, wherein the metallic component is sealed within the vessel in an amount greater than about 0.2 μO/ml.

8. The lamp in accordance with claim 1, wherein the available oxygen comprises a concentration of from about 0.1 to about 3.0 μmol O/ml.

9. The lamp in accordance with claim 1, wherein the source of available oxygen comprises an oxide or oxyhalide of at least one of Hg, Ba, Zr, Hf, W, Eu, Yb, or Lu.

10. The lamp in accordance with claim 1, wherein the halide component further comprises an alkaline earth metal halide component.

11. The lamp in accordance with claim 1, wherein the halide component further comprises at least one of halide of a Group 13 metal.

12. The lamp in accordance with claim 1, wherein the halide component further comprises at least one halide of a transition metal element.

13. The lamp in accordance with claim 1, wherein the rare earth halide component is free of rare earth halides that form stable oxides.

14. The lamp in accordance with claim 1, wherein the rare earth halide component comprises a halide of one or more selected from lanthanum, cerium, praseodymium, neodymium, or samarium.

15. The lamp in accordance with claim 1, wherein the discharge vessel comprises a wall comprised of a substantially translucent or transparent ceramic material.

16. The lamp in accordance with claim 1, wherein the lamp exhibits greater initial lumen output versus an identical lamp without the metallic component.

17. A method, comprising:

sealing a source of available oxygen, a metallic component, and an ionizable fill within a. discharge vessel comprised of a ceramic material, the fill comprising Hg, a buffer gas component, and a halide component comprising at least an alkali metal halide component and a rare earth halide component; and positioning electrodes within the discharge vessel configured to energize the fill in response to a voltage applied thereto;

wherein materials and quantities of the source of available oxygen and of the metallic component are selected to provide available oxygen in the lamp during lamp operation and wherein le available oxv en corn ises a. concentration of at least about 5 μmol O/ml.

18. A method comprising:

sealing a metallic component in a discharge vessel of a lamp;

wherein said lamp comprises: a discharge vessel comprised of a ceramic material; at least one electrode extending into the discharge vessel; an ionizable till sealed within the discharge vessel, the fill comprising Hg, a buffer gas component, and a halide component comprising at least an alkali metal halide component and a. rare earth halide component; and a. source of available oxygen;

wherein materials and quantities of the source of available oxygen and of the metallic component are selected to provide available oxygen in the lamp during lamp operation and wherein the available oxygen comprises a concentration of at least about 0.05 μmol O/mL.

19. The method in accordance with claim 18, wherein the method is capable of balancing the level of available oxygen for wall cleaning.

* * * * *